US012715636B1

(12) United States Patent
Xu et al.

(10) Patent No.: US 12,715,636 B1
(45) Date of Patent: Aug. 25, 2026

(54) MULTI-FUNCTIONAL VACUUM SEALER

(71) Applicant: Yumyth Electronic Tech co., ltd, Dongguan (CN)

(72) Inventors: Guoyong Xu, Dongguan (CN); Jian Zheng, Dongguan (CN)

(73) Assignee: Tianxi Wu, Pine Brook, NJ (US)

( * ) Notice: Subject to any disclaimer, the term of this patent is extended or adjusted under 35 U.S.C. 154(b) by 0 days.

(21) Appl. No.: 19/385,294

(22) Filed: Nov. 11, 2025

(51) Int. Cl.

| | |
|---|---|
| ***B65B 1/00*** | (2006.01) |
| ***B65B 31/00*** | (2006.01) |
| ***B65B 51/14*** | (2006.01) |
| ***B65B 57/00*** | (2006.01) |
| ***B65B 61/00*** | (2006.01) |

(52) U.S. Cl.
CPC ..... *B65B 31/00* (2013.01); *B65B 51/146* (2013.01); *B65B 57/00* (2013.01); *B65B 61/005* (2013.01)

(58) Field of Classification Search
CPC ..... B65B 31/00; B65B 51/146; B65B 57/00; B65B 61/005
USPC ..... 53/79
See application file for complete search history.

(56) References Cited

U.S. PATENT DOCUMENTS

| | | | | | |
|---|---|---|---|---|---|
| 4,779,398 | A * | 10/1988 | Glandon | B65B 31/022 | 53/512 |
| 4,922,686 | A * | 5/1990 | Segota | B65B 31/024 | 53/512 |
| 5,056,292 | A * | 10/1991 | Natterer | B29C 65/7451 | 53/373.4 |
| 5,239,808 | A * | 8/1993 | Wells | B65B 31/024 | 53/512 |
| 5,638,664 | A * | 6/1997 | Levsen | B65B 31/046 | 53/512 |
| 7,717,922 | B2 | 5/2010 | Neilson et al. | | |
| 9,327,854 | B2 | 5/2016 | Huang | | |
| 9,764,868 | B2 | 9/2017 | Hu et al. | | |
| 10,941,879 | B2 | 3/2021 | McDonald et al. | | |
| 11,008,126 | B2 | 5/2021 | Zheng | | |
| 2003/0046907 | A1* | 3/2003 | Costello | G01M 3/3218 | 53/512 |
| 2005/0011166 | A1* | 1/2005 | Germano | B65B 31/047 | 53/512 |
| 2005/0029152 | A1* | 2/2005 | Brakes | B65B 51/146 | 206/524.8 |
| 2014/0116003 | A1* | 5/2014 | Hammad | B65B 7/06 | 53/376.3 |
| 2015/0135641 | A1* | 5/2015 | Hu | B65B 31/024 | 53/86 |
| 2021/0380291 | A1* | 12/2021 | Dai | B65B 57/00 | |

* cited by examiner

*Primary Examiner* — Himchan Song

(57) ABSTRACT

A multifunctional vacuum sealer includes a casing, the side wall thereof is provided with a first vacuum cavity, and the upper section thereof is provided with a second vacuum cavity; an internal vacuum pumping and sealing mechanism situated within in the first vacuum cavity, and a cavity vacuum pumping and sealing mechanism, which includes a cavity-type air extraction port extending into the second vacuum chamber, a heating element assembly positioned in the second vacuum cavity, and a sealing panel hinged to one side of the second vacuum cavity; a vacuum pump assembly that communicates with both the internal vacuum pumping and sealing mechanism and the cavity vacuum pumping and sealing mechanism, controlling the vacuum pumping function of both; a control assembly, which includes a power supply unit and a control panel.

16 Claims, 8 Drawing Sheets

MULTI-FUNCTIONAL VACUUM SEALER

FIELD OF THE INVENTION

The disclosure relates to the technical field of sealing devices, particularly, to a multi-functional vacuum sealer.

BACKGROUND OF THE INVENTION

Vacuum sealers are primarily utilized for packaging products in industries such as food, pharmaceuticals, and chemical engineering. Their operation involves extracting air from the bag with a vacuum pump to establish a vacuum environment. Subsequently, the bag's opening is heated by a heating plate to increase its temperature. Once the bag opening reaches a specific temperature, the sealer is pressed down. The heat transferred from the heating plate melts the bag opening, causing it to adhere and form a sealing line quickly. Sealed bags can significantly prolong the freshness of food, pharmaceuticals, and chemical products, preventing spoilage. They are widely used in daily life and industrial production.

The internal air extraction mechanism of the vacuum sealer does not require a specific bag length; however, it necessitates the use of bags with textured inner surfaces to achieve the desired vacuum effect. Nevertheless, when sealing bags containing liquid items, the vacuum sealing process is less effective, and there is a tendency for the liquid to leak. On the other hand, the cavity-type vacuum extraction system does not require a specific bag structure and can vacuum-seal a bag containing liquid. However, the size of the bag is limited by the dimensions of the vacuum cavity. Existing vacuum sealers typically feature only one type of vacuum extraction mechanism, which fails to accommodate various usage scenarios.

SUMMARY OF THE INVENTION

The disclosure aims to address at least one technical issue prevalent in prior art, which states that "Existing vacuum sealers typically feature only one type of vacuum extraction structure, unable to cater to various usage scenarios." Consequently, the disclosure presents a multi-functional vacuum sealer. This sealer is compact and incorporates both internal exhaust vacuum sealing and cavity vacuum sealing structures. It can fulfill the vacuum sealing needs for both liquid and solid items, and is suitable for sealing bags with either smooth or textured inner surfaces.

According to some embodiments of the disclosure, the multifunctional vacuum sealer comprises a casing. The side wall of the casing is provided with a first vacuum cavity, and the upper section is provided with a second vacuum cavity.

The multifunctional vacuum sealer further comprises an internal vacuum pumping and sealing mechanism, situated within the first vacuum chamber, and a cavity vacuum pumping and sealing mechanism, which includes a cavity-type air extraction port that extends into the second vacuum chamber, a heating element assembly positioned within the second vacuum chamber, and a sealing panel hinged to one side of the second vacuum chamber.

The multifunctional vacuum sealer further includes a vacuum pump assembly that communicates with both the internal vacuum pumping and sealing mechanism and the cavity vacuum pumping and sealing mechanism, controlling the vacuum pumping function of both.

The multifunctional vacuum sealer also features a control assembly, which comprises a power supply unit and a control panel. The power supply unit is electrically connected to the internal vacuum pumping and sealing mechanism, the cavity vacuum pumping and sealing mechanism, as well as the vacuum pump assembly. The control panel is situated within the upper section of the casing.

According to some embodiments of the disclosure, a ring of sealing strip is provided on the periphery of the second vacuum chamber; when the sealing panel and the second vacuum chamber are closed, a sealed state is formed inside the second vacuum chamber.

According to some embodiments of the disclosure, the sealing panel is made of transparent material, when the sealing panel covers and seals the second vacuum chamber, the vacuum state can be observed through the sealing panel.

According to some embodiments of the disclosure, the multifunctional vacuum sealer further includes a cutter assembly. Its bottom is hinged to the casing, the middle part is connected with the sealing panel, and the top is used for cutting the sealing bag.

According to some embodiments of the disclosure, the cavity vacuum pumping and sealing mechanism comprises a bag opening pressing assembly, positioned on one side of the heating element assembly. The bag opening pressing assembly includes a pressing base and a pressing plate hinged to the pressing base. When the bag opening of the sealing bag is placed on the pressing base, the pressing plate is rotated to compress the bag opening.

According to some embodiments of the disclosure, the cavity vacuum pumping and sealing mechanism comprises a bag opening pressing assembly, which is disposed on one side of the heating element assembly. The bag opening pressing assembly includes a pressing base and a bracket that is rotatably mounted on the pressing base. The pressing base is provided with at least one magnet, and the bracket is equipped with at least one metal sheet or magnetic sheet. The magnet and the metal sheet or magnetic sheet are attracted to each other by magnetic force.

According to some embodiments of the disclosure, the bottom of the heating element assembly is equipped with a closing cylinder that facilitates the closure of the heating element assembly. The top of the heating element assembly is fitted with a silicone strip that is connected to the sealing panel. The closing cylinder is linked to the vacuum pump assembly, which propels the closing cylinder upwards. This action, in turn, elevates the heating element assembly, allowing the bag opening of the sealing bag to be compressed between the silicone strip and the heating element assembly, thus achieving the heating and sealing of the bag opening.

The ejector pin of the closing cylinder is made of metal. It is encased in a silicone protective sleeve that abuts against the bottom of the heating element assembly. When the closing cylinder is actuated, it propels the heating element assembly upward, causing it to strike the silicone strip. With each successive actuation, the force intensifies, and eventually, the ejector pin is expelled from the silicone protective sleeve. It then makes contact with the electrode at the base of the heating element assembly, allowing for electrical conduction and initiating the heating process.

According to some embodiments of the disclosure, the internal vacuum pumping and sealing mechanism comprises a cover plate, an opening and closing pump that drives the cover plate to press down, and a water tank positioned below the cover plate.

A pressing cylinder is positioned on a top of the cover plate; the vacuum pump assembly drives the pressing cylinder to ensure the cover plate to seal against the water tank, forming a sealed cavity.

The vacuum pump assembly communicates with the cover plate; when the cover plate closes, it seals the water tank to form a sealed cavity. The vacuum pump assembly then evacuates the sealed cavity.

According to some embodiments of the disclosure, the water tank is detachably connected to the first vacuum chamber.

According to some embodiments of the disclosure, a reversing valve is respectively positioned between the vacuum pump assembly and the internal vacuum pumping and sealing mechanism, as well as between the vacuum pump assembly and the cavity vacuum pumping and sealing mechanism. The reversing valve serves to switch the vacuum pump assembly to evacuate the corresponding vacuum cavity.

According to some embodiments of the disclosure, the second vacuum chamber creates a recessed space on the upper section of the casing.

According to some embodiments of the disclosure, the multi-functional vacuum sealer has at least the following advantages: the casing is equipped with both an internal vacuum pumping and sealing mechanism and a cavity vacuum pumping and sealing mechanism, which can meet the vacuum sealing requirements of liquid-containing items and ordinary items, and is applicable to different types of sealing bags. This meets the requirements for use in various scenarios. The integrated design, with the positions of the first vacuum cavity and the second vacuum cavity reasonably arranged, helps to reduce the volume of the multi-functional vacuum sealer. It has multiple functions while reducing the equipment volume, making it convenient to use.

Additional aspects and advantages of the disclosure will be partly presented in the following description, partly become apparent from the description, or will be learned through the practice of the disclosure.

BRIEF DESCRIPTION OF THE DRAWINGS

The foregoing and/or further aspects and advantages of the disclosure will become apparent and readily understood from the description of the embodiments, in conjunction with the accompanying drawings, wherein.

DETAILED DESCRIPTION OF ILLUSTRATED EMBODIMENTS

Figure 1:
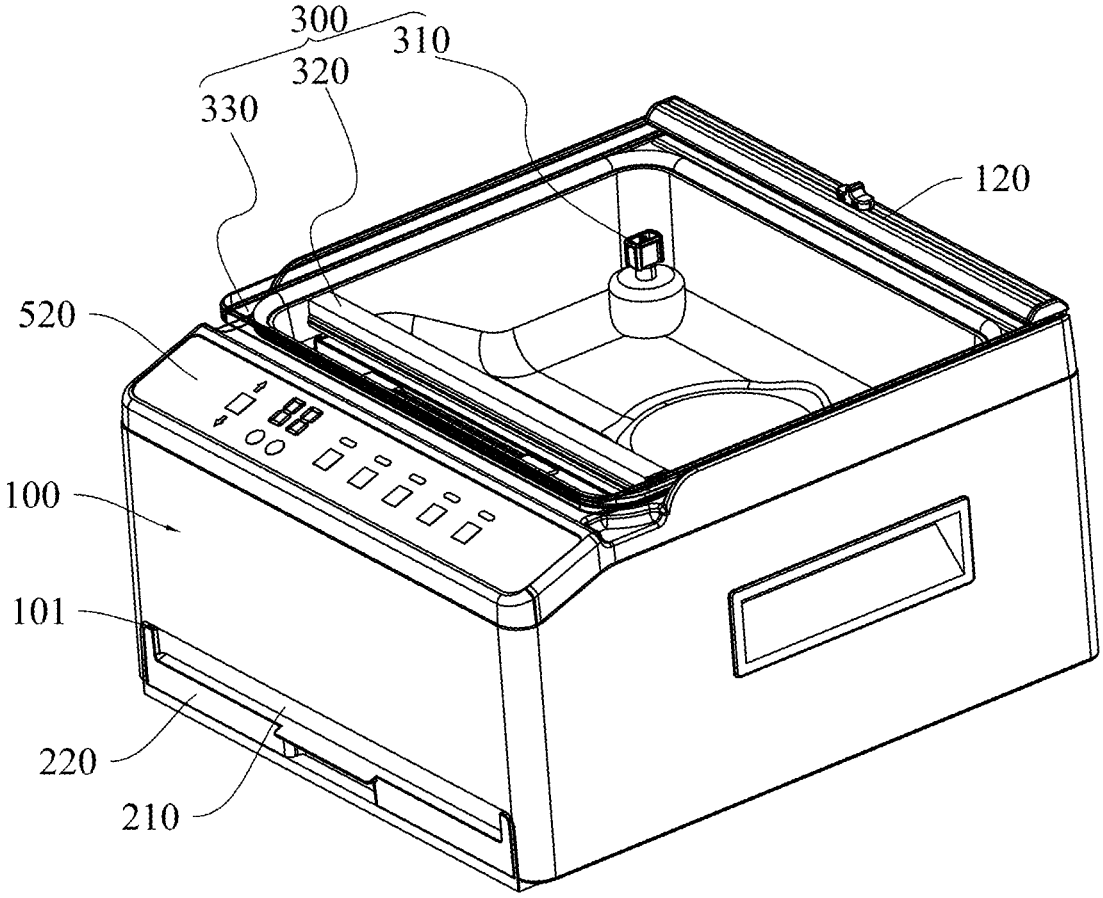
FIG. 1 is a perspective view of a multifunctional vacuum sealer according to an embodiment of the disclosure.

The embodiments of the disclosure are described in detail below. Examples of these embodiments are depicted in the accompanying drawings, where identical or similar reference numerals denote identical or similar elements or elements with identical or similar functions. The embodiments discussed below with reference to the accompanying drawings are illustrative and are intended solely for explaining the disclosure; they should not be construed as limiting the scope of the disclosure.

In the description of the disclosure, it is essential to understand that references to orientation, such as up, down, front, back, left, right, top, and bottom, are based on the orientation or positional relationship depicted in the drawings. These terms are used solely for the convenience of describing the disclosure and to simplify the explanation; they do not imply that the device or element in question must have a specific orientation, nor that it must be constructed or operated in a particular way. Consequently, these terms should not be interpreted as limiting the scope of the disclosure.

In the description of the disclosure, "several" means one or more, and "multiple" means more than two. Terms such as "greater than," "less than," and "more than" are understood to exclude the original number, while terms like "above," "below," and "within" are understood to include the original number. If the first and second are described solely for the purpose of distinguishing technical features, they should not be interpreted as indicating or implying relative importance or implicitly suggesting the quantity or sequence of the technical features indicated.

In the description of the present disclosure, unless explicitly limited otherwise, terms such as setting, installation, connection, and the like should be interpreted broadly. Those skilled in the art can reasonably ascertain the specific meanings of these terms within the present disclosure, based on the technical solution's specific content.

The multifunctional vacuum sealer according to the embodiment of the disclosure will be described below with reference to FIGS. 1-8.

Figure 2:
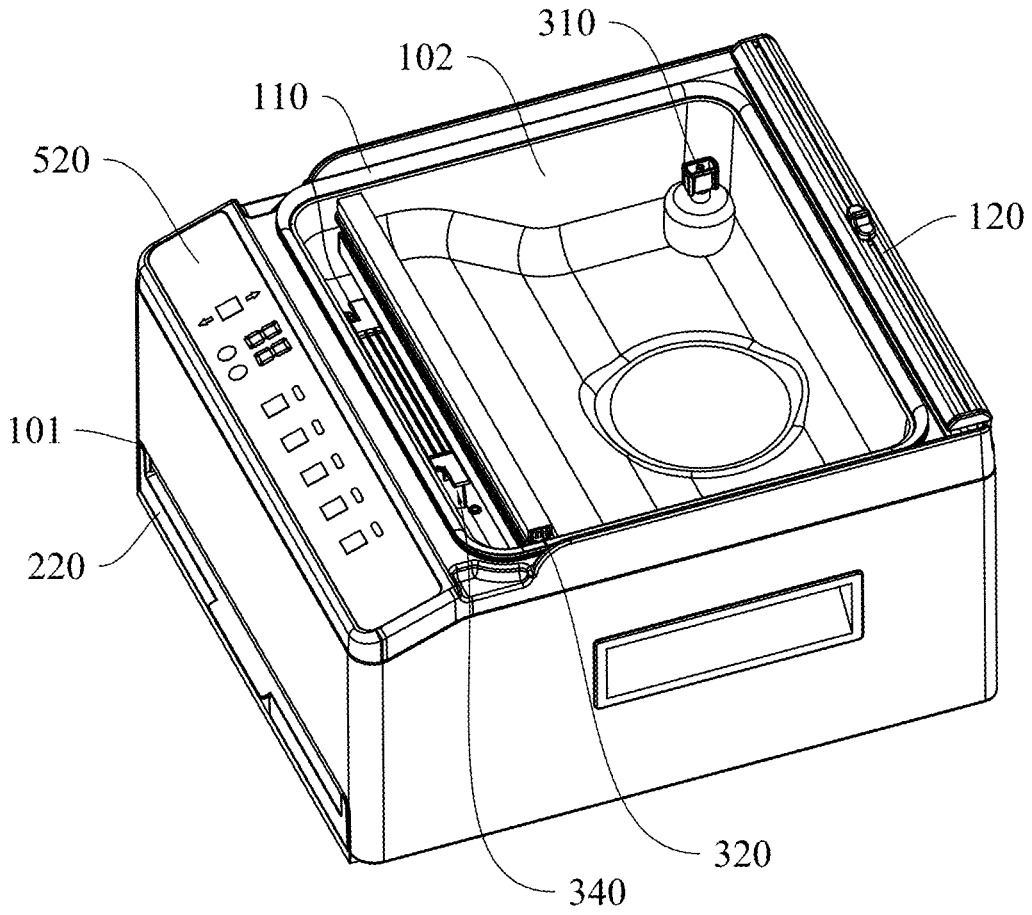
FIG. 2 is a first partial schematic diagram of the multi-functional vacuum sealer according to an embodiment of the disclosure.

As illustrated in FIGS. 1-2, the multifunctional vacuum sealer 100 comprises a casing 100, the side wall of which is made from either metal or plastic material to accommodate various usage environments. A first vacuum chamber 101 is situated on the side wall of the casing 100, while a second vacuum chamber 102 is located on the upper section of the casing 100.

Specifically, an internal vacuum pumping and sealing mechanism 200 is arranged within the first vacuum chamber 101, designed for vacuum-sealing sealing bags with internal textures. This is particularly suitable for items that do not contain liquid. The internal vacuum pumping and sealing mechanism 200 is capable of sealing sealing bags of any length, with no restrictions on the length of the bags.

A cavity vacuum pumping and sealing mechanism 300 is arranged within the second vacuum chamber 102. It comprises a cavity-type air extraction port 310 that extends into the second vacuum chamber 102, a heating element assembly 320 positioned within the second vacuum cavity 102, and a sealing panel 330 hinged to one side of the second vacuum cavity 102. The cavity-type air extraction port 310 is capable of evacuating the entire second vacuum cavity 102, allowing the sealing bags within the second vacuum cavity 102 to gradually reach a vacuum state.

Figure 5:
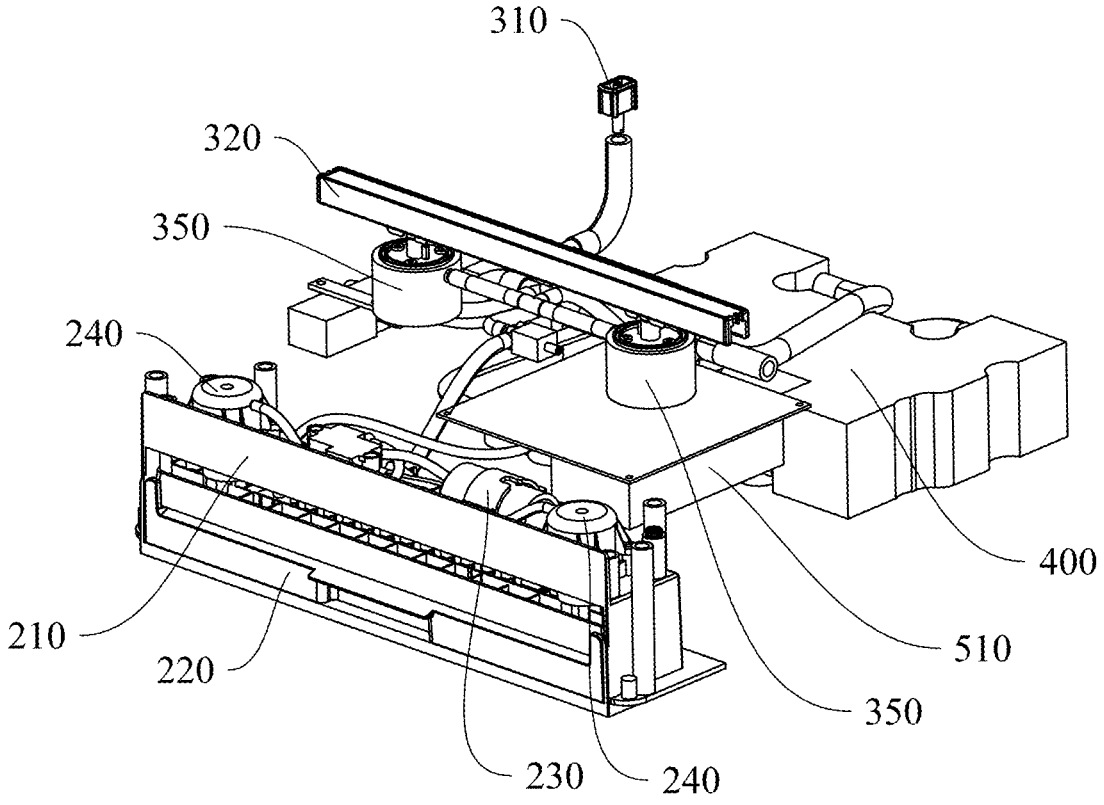
FIG. 5 is an inner partial schematic diagram of the multifunctional vacuum sealer according to an embodiment of the disclosure.
Figure 6:
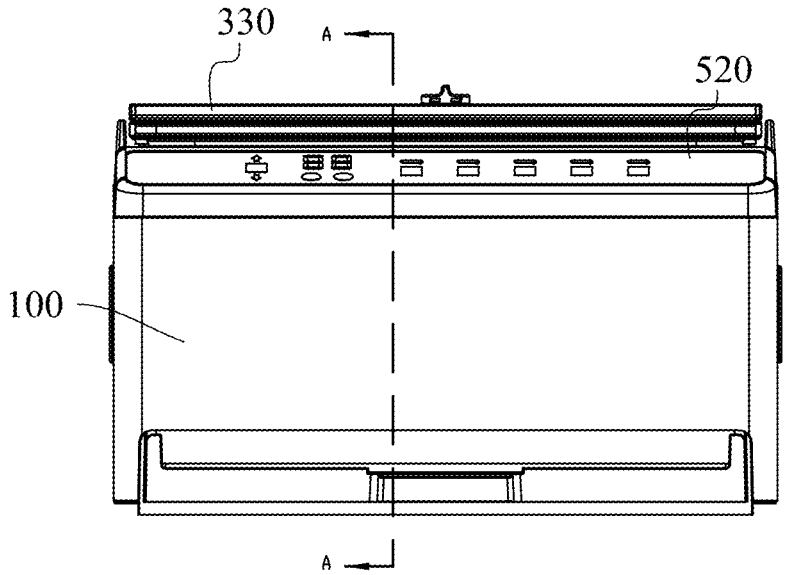
FIG. 6 is a front view of a multifunctional vacuum sealer according to an embodiment of the disclosure.
Figure 7:
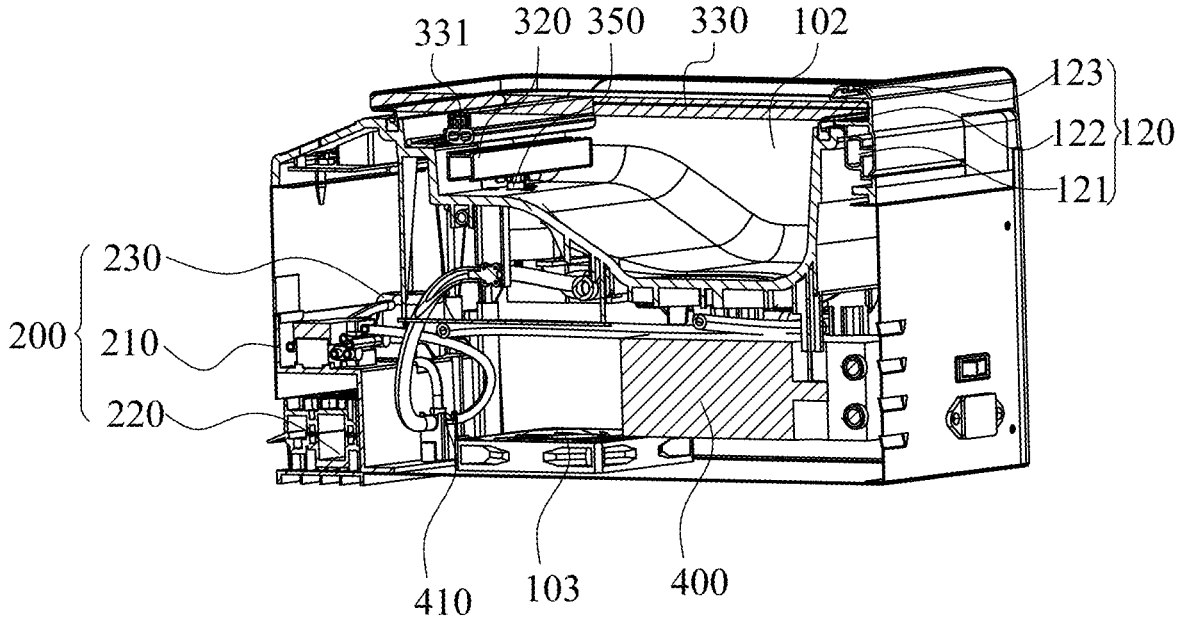
FIG. 7 is an in-section view along line A-A in FIG. 6.
Figure 9:
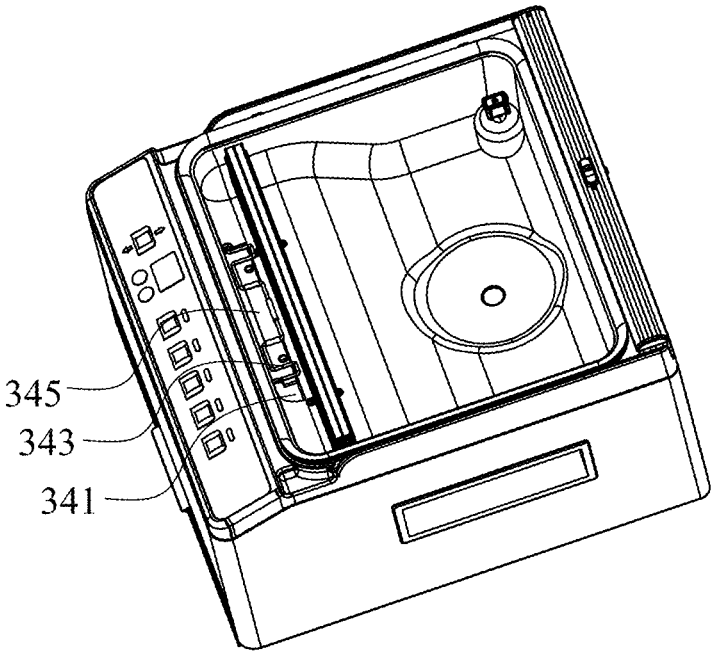
FIG. 9 is a perspective view of the multifunctional vacuum sealer according to another embodiment in the disclosure.

As shown in FIGS. 5, 7, and 9, the multifunctional vacuum sealer also comprises a vacuum pump assembly 400. This vacuum pump assembly 400 is situated within the casing 100, at the lower section, thereby maximizing space in the upper portion of the casing 100 and facilitating an increase in the volume of the second vacuum chamber 102. The vacuum pump assembly 400 communicates with both the internal vacuum pumping and sealing mechanism 200 and the cavity vacuum pumping and sealing mechanism 300. Specifically, the cavity-type air extraction port 310 within the cavity vacuum pumping and sealing mechanism 300 is linked to the vacuum pump assembly 400. To ensure the vacuum sealer's efficiency, the vacuum pump assembly 400 is designed to control either the internal vacuum pumping and sealing mechanism 200 or the cavity vacuum pumping and sealing mechanism 300 exclusively at any given time.

In the embodiment, the vacuum pump assembly 400 utilizes a four-head vacuum pump. In alternative embodiments, a vacuum pump with greater power may also be selected based on the power requirements.

The multifunctional vacuum sealer also features a control assembly. This assembly comprises a power supply unit 510 and a control panel 520. The power supply unit 510 is housed within the casing 100 and electrically connected to the internal vacuum pumping and sealing mechanism 200, the cavity vacuum pumping and sealing mechanism 300, and the vacuum pump assembly 400, respectively. The control panel 520 is situated inside the upper portion of the casing 100. More specifically, the control panel 520 is positioned between the internal vacuum pumping and sealing mechanism 200 and the cavity vacuum pumping and sealing mechanism 300, at the top of the casing 100. The control panel 520 is angled to allow for easier user operation.

Figure 3:
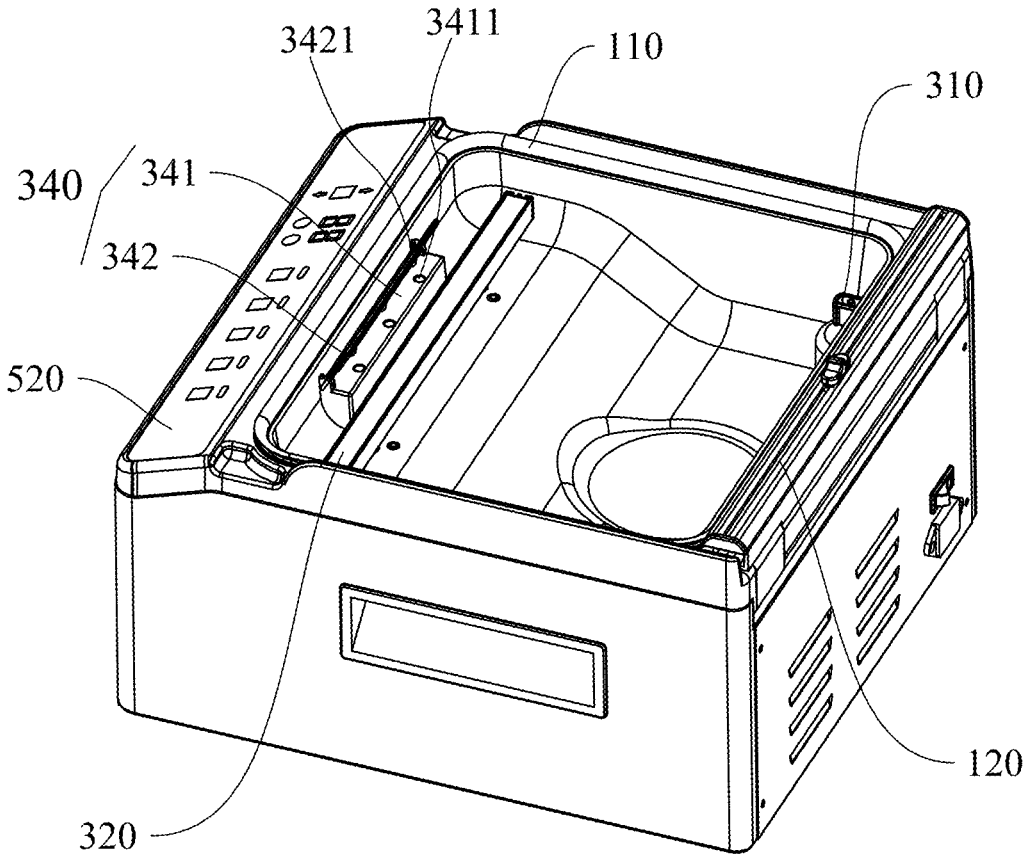
FIG. 3 is a second partial schematic diagram of the multifunctional vacuum sealer according to an embodiment of the disclosure.
Figure 4:
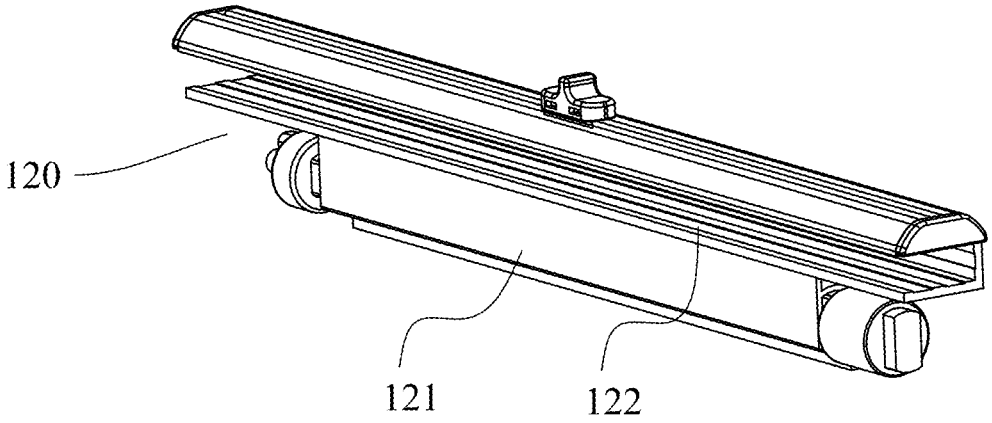
FIG. 4 is a schematic diagram of the cutter assembly of the multifunctional vacuum sealer according to an embodiment of the disclosure.

In some embodiments of the disclosure, as shown in FIGS. 2 and 3, a ring of sealing strip 110 is provided on a periphery of the second vacuum chamber 102. When the sealing panel 330 and the second vacuum chamber 102 are closed, a sealed state is formed inside the second vacuum chamber 102.

Specifically, when the second vacuum chamber 102 is in the vacuuming state, to prevent the gap between the sealing panel 330 and the second vacuum chamber 102 from affecting the vacuuming efficiency, a sealing strip 110 is provided to fill the gap, achieving a complete seal. This effectively improves the vacuuming efficiency of the second vacuum chamber 102.

In some embodiments of the disclosure, as shown in FIG. 1, the sealing panel 330 is made of a transparent material. When the sealing panel 330 covers and seals the second vacuum chamber 102, the vacuum state can be observed through the sealing panel 330. Specifically, the sealing panel 330 employs a transparent tempered glass panel to ensure structural integrity while allowing observation of the internal vacuum state, facilitating user convenience to check at any time whether the bag opening of the sealing bag is properly clamped or if the sealing effect meets expectations.

In some embodiments of the disclosure, as shown in FIGS. 1-4 and 6-7, the multifunctional vacuum sealer further comprises a cutter assembly 120. Its bottom is hinged to the casing 100, the middle part is connected to the sealing panel 330, and the top is designed for cutting the sealing bag.

Specifically, the bottom of the cutter assembly 120 is designed as a rotating shaft structure. The bottom of the cutter assembly 120 is provided with a rotating shaft 121 hinged to the casing 100, and the middle part of the cutter assembly 120 is provided with a groove 122 to fix and install the sealing panel 330. When the sealing panel 330 is lifted, it is turned over with the bottom of the cutter assembly 120 as the rotation center, and the sealing panel 330 and the cutter assembly 120 move synchronously. The top of the cutter assembly 120 is provided with a conventional cutter 123, which can cut the sealing bag.

In some embodiments of the disclosure, as shown in FIGS. 2-3, the cavity vacuum pumping and sealing mechanism 300 comprises a bag opening pressing assembly 340, positioned on one side of the heating element assembly 320. The bag opening pressing assembly 340 includes a pressing base 341 and a pressing plate 342 hinged to the pressing base 341. When the bag opening of the sealing bag is placed on the pressing base 341, the pressing plate 342 is rotated to compress the bag opening.

Specifically, the pressing base 341 is integrally formed with the casing 100, and one side of the pressing plate 342 is hinged to the pressing base 341. The bag opening of the sealing bag passes through the heating element assembly 320 and is laid on the pressing base 341. The pressing plate 342 presses down to fix the bag opening between the pressing base 341 and the pressing plate 342. The pressing base 341 and the pressing plate 342 are respectively equipped with pressing blocks 3411 and pressing grooves 3421 that cooperate with each other, allowing the pressing base 341 and the pressing plate 342 to achieve point-to-point contact. This means that when the bag opening is compressed, only a few points on the bag opening between the pressing blocks and the pressing grooves are compressed, while the remaining positions of the bag opening remain open. This does not affect the subsequent vacuuming operation.

Figure 8:
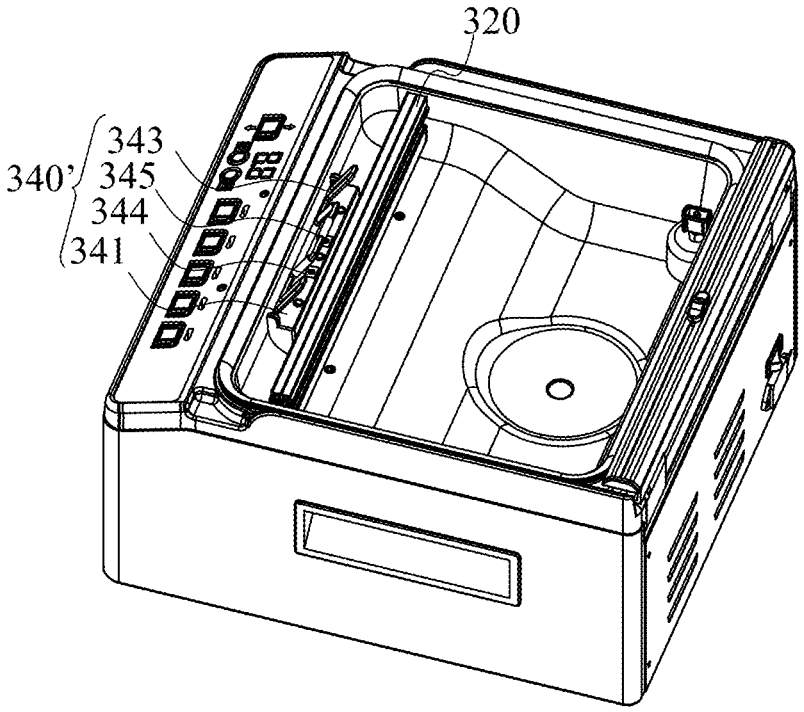
FIG. 8 is a perspective view of the multifunctional vacuum sealer according to another embodiment in the disclosure.

In another embodiment of the bag opening pressing assembly, as shown in FIGS. 8 and 9, the bag opening pressing assembly 340' is positioned on one side of the heating element assembly 320. It comprises a pressing base 341 and a bracket 343 that is hinged to the pressing base 341. The pressing base 341 is equipped with at least one magnet 344, while the bracket 343 is equipped with at least one corresponding metal sheet or magnetic sheet 345. The magnet 344 and the metal sheet or magnetic sheet 345 are attracted to each other by magnetic force. During use, the bracket 343 is rotated to move it away from the pressing base 341. The bag opening of the sealing bag is then placed on the pressing base 341. Upon releasing the bracket 343, the magnetic attraction between the magnet 344 and the metal sheet or magnetic sheet 345 causes the bracket to rotate back towards the pressing base 341, thereby securing the bag opening of the sealing bag.

In some embodiments of the disclosure, as shown in FIGS. 5, 7, 10, and 11, the bottom of the heating element assembly 320 is equipped with a closing cylinder 350 that facilitates the closure of the heating element assembly 320. The top of the heating element assembly 320 is fitted with a silicone strip 331, which is connected to the sealing panel 330. The closing cylinder 350 is linked to the vacuum pump assembly 400. The vacuum pump assembly 400 propels the closing cylinder 350 to move upward, consequently elevating the heating element assembly 320. This action compresses the bag opening of the sealing bag between the silicone strip 331 and the heating element assembly 320, thereby achieving the heating and sealing of the bag opening.

Figure 12:
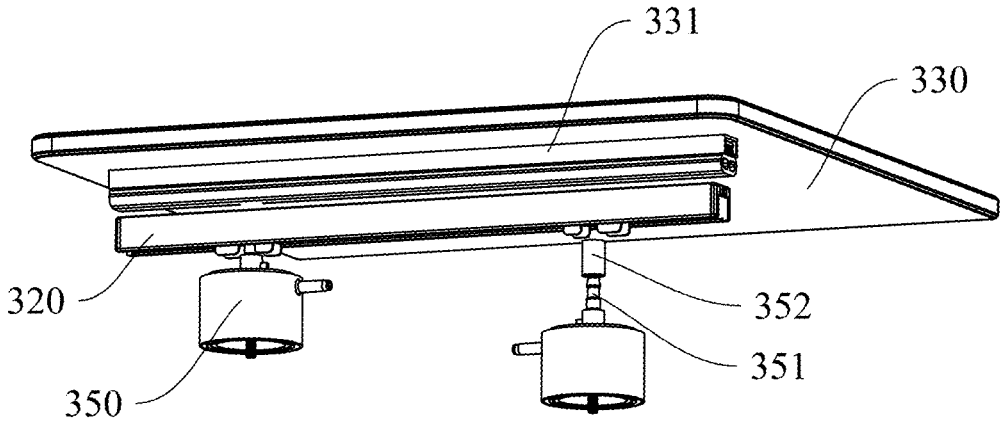
FIG. 12 is a heat sealing schematic diagram of the cavity vacuum sealing structure according to the embodiment of the disclosure.

In some embodiments of the disclosure, as shown in FIG. 12, the ejector pin 351 of the closing cylinder 350 is made of metal. The ejector pin 351 is encased in a silicone protective sleeve 352, which abuts against the bottom of the heating element assembly 320. When the closing cylinder 350 is actuated, it propels the heating element assembly 320 upward to strike the silicone strip 331. With each successive actuation, a force intensifies, and eventually the ejector pin 351 is expelled from the silicone protective sleeve 352, comes into contact with the electrode at a bottom of the heating element assembly 320, allowing for electrical conduction and initiating a heating process.

The heating and sealing principle and structure of the heating element assembly 320 are well-known technical solutions to those skilled in the art and will not be described in detail in this embodiment. The closing cylinder 350 is controlled by the vacuum pump assembly 400. When the vacuum level in the second vacuum chamber 102 reaches a predetermined value, the heating element assembly 320 is heated, and the vacuum pump assembly 400 actuates the heating element assembly 320 to clamp the bag opening of the sealing bag, thereby performing the sealing operation. Initially, the heating element assembly 320 is pushed to press the bag opening firmly, followed by the initiation of heating and sealing of the bag opening. The silicone protective sleeve 352, serving as a protective structure, ensures that as long as the heating element assembly 320 and the silicone strip 331 do not press the bag opening firmly, the electrode of the ejector rod 351 of the closing cylinder 350 cannot come into contact with the electrode of the heating element assembly 320, thus preventing the heating from starting.

The silicone protective sleeve 352 functions as the electrode protection component for the closing cylinder 350. During the normal air extraction process, the silicone protective sleeve 352 is in contact with the bottom of the heating element assembly 320. At this point, the heating element assembly 320 and the ejector rod 351 are not conducting electricity, thus preventing any false heating. When heating is necessary, the closed cylinder 350 raises the ejector rod 351, allowing the heating element assembly 320 to come into contact with the silicone strip 331. With continuous force applied to push upwards, the ejector rod 351 extends from the silicone protective sleeve 352 and makes contact with the electrode of the heating element assembly 320, enabling electrical conduction. This action allows the heating element assembly 320 to conduct electricity and generate heat.

In some embodiments of the disclosure, as shown in FIGS. 5-7, 10, and 11, the internal vacuum pumping and sealing mechanism 200 comprises a cover plate 210, an opening and closing pump 230 that drives the cover plate 210 to press down, and a water tank 220 positioned below the cover plate 210. A pressing cylinder 240 is situated on the top of the cover plate 210. The vacuum pump assembly 400 actuates the pressing cylinder 240 to enable the cover plate 210 to close with the water tank 220, forming a sealed cavity. The vacuum pump assembly 400 is in communication with the cover plate 210 and is used to evacuate the sealed cavity.

Specifically, the user positions the bag opening of the sealing bag between the water tank 220 and the cover plate 210. The opening-closing pump 230 then closes the cover plate 210, securing the bag opening within the sealed cavity. To ensure the vacuum efficiency of the vacuum pump assembly 400, the cover plate 210 is pressed down independently by the opening-closing pump 230, thereby guaranteeing the efficient operation of the vacuum pump assembly 400. The vacuum pump assembly 400 removes the air from the sealed cavity and the sealing bag, while the liquid extracted from the sealing bag is directed into the water tank 220. Additionally, a heating and sealing structure is integrated into the cover plate 210. This technical solution is well understood by those skilled in the art and will not be elaborated upon in this instance.

Figure 10:
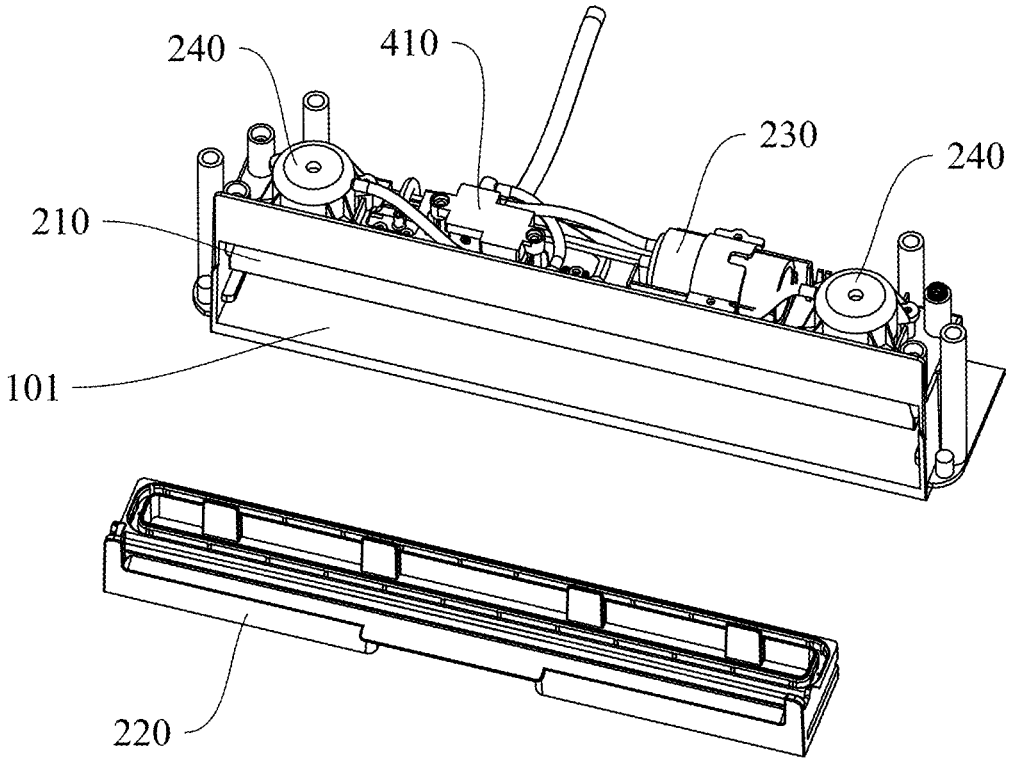
FIG. 10 is a schematic diagram of the internal vacuum sealing structure of the multifunctional vacuum sealer according to the embodiment of the disclosure.
Figure 11:
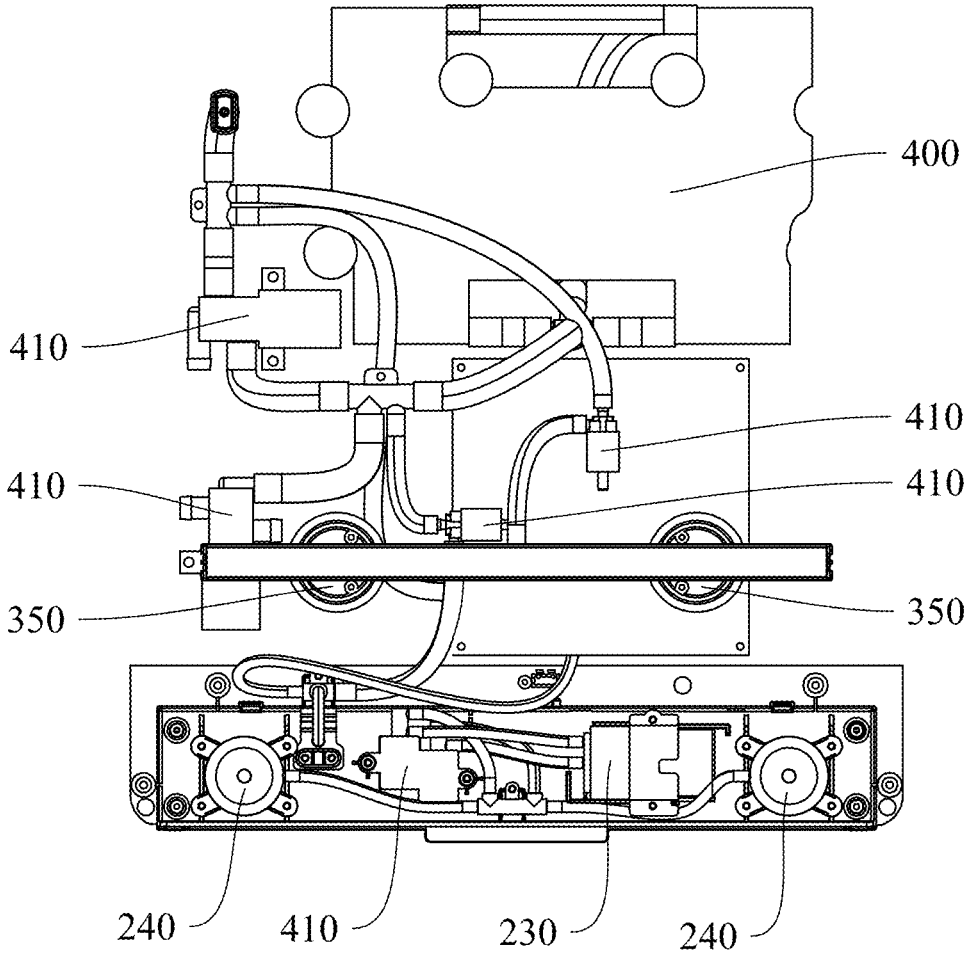
FIG. 11 is a pipeline connection diagram of the vacuum pump assembly of the multifunctional vacuum sealer according to the embodiment of the disclosure.

In another embodiment, as shown in FIG. 10, the water tank 220 is detachably connected to the first vacuum chamber 101. Specifically, the water tank 220 features a drawer-like structure, allowing it to be pulled out for easy cleaning.

In some embodiments of the disclosure, as shown in FIGS. 5-7 and 11, a reversing valve 410 is respectively arranged between the vacuum pump assembly 400 and the internal vacuum pumping and sealing mechanism 200, and between the vacuum pump assembly 400 and the cavity vacuum pumping and sealing mechanism 300. The reversing valve 410 is used to switch the vacuum pump assembly 400 to evacuate the corresponding vacuum cavity.

Specifically, the vacuum pump assembly 400 in this embodiment has three operating conditions: evacuating the second vacuum chamber 102, driving the closing cylinder 350, and driving the internal vacuum pumping and sealing mechanism 200. These three operating conditions function independently of one another. When the vacuum pump assembly 400 drives the internal vacuum pumping and sealing mechanism 200 to operate, the reversing valve 410 switches the pipeline state to connect the vacuum pump assembly 400 with the internal vacuum pumping and sealing mechanism 200. When the second vacuum chamber 102 is being evacuated, the reversing valve 410 connects the vacuum pump assembly 400 to the chamber-type air extraction port 310. When the heating element assembly 320 heats and seals the bag opening of the sealing bag, the reversing valve 410 connects the vacuum pump assembly 400 to the closing cylinder 350.

The number of reversing valves 410 is set according to actual needs. The structure of the reversing valve 410 will not be described in this disclosure. The switching of pipeline connections by the reversing valve 410 is a technical solution well-known to those skilled in the art, and will not be described in detail in this embodiment.

In some embodiments of the disclosure, as shown in FIGS. 2, 3, and 7, the second vacuum chamber 102 forms a recessed space on the top part of the casing 100. Specifically, both the power supply unit 510 and the vacuum pump assembly 400 adopt an underside-mounted structure, ensuring there is sufficient space below the second vacuum chamber 102 to extend into the casing 100. This increases the volume of the second vacuum chamber 102 and enables vacuum sealing operations on larger-sized sealing bags.

In some embodiments of the disclosure, as shown in FIG. 7, a cooling fan 103 is further arranged inside the casing 100 to dissipate heat inside.

In this specification, references to terms such as "one embodiment," "some embodiments," "an exemplary embodiment," "an example," "a specific example," or "some examples" indicate that the specific features, structures, materials, or characteristics described in conjunction with the embodiment or example are included in at least one embodiment or example of the utility model. In this document, the schematic representations of the aforementioned terms do not necessarily refer to the same embodiment or example. Additionally, the described specific features, structures, materials, or characteristics may be combined in any suitable manner across one or more embodiments or examples.

Although the embodiments of the disclosure have been shown and described, those of ordinary skill in the art will understand that various changes, modifications, substitutions, and variations can be made to these embodiments without departing from the principles and purposes of the disclosure. The scope of the disclosure is defined by the claims and their equivalents.

What is claimed is:

1. A multifunctional vacuum sealer, comprising a casing, a side wall thereof is provided with a first vacuum cavity, and a top thereof is provided with a second vacuum cavity; further comprising:

an internal vacuum pumping and sealing mechanism, arranged in said first vacuum cavity;

a cavity vacuum pumping and sealing mechanism, including a cavity-type air extraction port that extends into said second vacuum chamber, a heating element assembly positioned within said second vacuum chamber, and a sealing panel hinged to one side of said second vacuum chamber;

a vacuum pump assembly, communicating with both said internal vacuum pumping and sealing mechanism and said cavity vacuum pumping and sealing mechanism;

a control assembly, comprising a power supply unit and a control panel; said power supply unit is electrically connected to said internal vacuum pumping and sealing mechanism, said cavity vacuum pumping and sealing mechanism, and said vacuum pump assembly; said control panel is situated within an upper section of said casing.

2. The multifunctional vacuum sealer according to claim 1, wherein a ring of sealing strip is provided on a periphery of said second vacuum chamber; when said sealing panel and said second vacuum chamber are closed, a sealed state is formed inside said second vacuum chamber.

3. The multifunctional vacuum sealer according to claim 2, wherein said sealing panel is made of transparent material, when said sealing panel covers and seals said second vacuum chamber, said vacuum state can be observed through said sealing panel.

4. The multifunctional vacuum sealer according to claim 1, further comprising a cutter assembly, a bottom thereof is hinged to said casing, a middle part thereof is connected with said sealing panel, and a top thereof is used for cutting said sealing bag.

5. The multifunctional vacuum sealer according to claim 1, wherein said cavity vacuum pumping and sealing mechanism comprises a bag opening pressing assembly, positioned on one side of said heating element assembly; said bag opening pressing assembly includes a pressing base and a pressing plate hinged to said pressing base; when a bag opening of a sealing bag is placed on said pressing base, said pressing plate is rotated to compress said bag opening.

6. The multifunctional vacuum sealer according to claim 5, wherein said cavity vacuum pumping and sealing mechanism includes a bag opening pressing assembly, positioned on one side of said heating element assembly, said bag opening pressing assembly includes a pressing base and a bracket hinged to said pressing base; said pressing base is provided with at least one magnet, while said bracket is equipped with at least one metal sheet; said magnet and said metal sheet are attracted to each other by magnetic force.

7. The multifunctional vacuum sealer according to claim 1, wherein a bottom of said heating element assembly is equipped with a closing cylinder that facilitates a closure of said heating element assembly, and a top thereof is fitted with a silicone strip connected to said sealing panel; said closing cylinder is linked to said vacuum pump assembly, which propels said closing cylinder upward, consequently elevating said heating element assembly, allowing a bag opening of a sealing bag to be compressed between said silicone strip and said heating element assembly, thus achieving a heating and sealing of said bag opening;

an ejector pin of said closing cylinder is made of metal and encased in a silicone protective sleeve, which abuts against a bottom of said heating element assembly; when said closing cylinder is actuated to propel said heating element assembly upward and strike said silicone strip; with each successive actuation, a force intensifies, and eventually, said ejector pin is expelled from said silicone protective sleeve, comes into contact with electrodes at a bottom of said heating element assembly at a base of said heating element assembly, allowing for electrical conduction and initiating a heating process.

8. The multifunctional vacuum sealer according to claim 1, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

9. The multifunctional vacuum sealer according to claim 2, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

10. The multifunctional vacuum sealer according to claim 3, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

11. The multifunctional vacuum sealer according to claim 4, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

12. The multifunctional vacuum sealer according to claim 5, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

13. The multifunctional vacuum sealer according to claim 6, wherein said internal vacuum pumping and sealing mechanism includes a cover plate, an opening and closing pump that drives said cover plate to press down, and a water tank positioned below said cover plate;

a pressing cylinder is positioned on a top of said cover plate; said vacuum pump assembly drives said pressing cylinder to ensure said cover plate to seal against said water tank, forming a sealed cavity;

said vacuum pump assembly communicates with said cover plate, when said cover plate closes said water tank to form a sealed cavity, said vacuum pump assembly evacuates said sealed cavity.

14. The multifunctional vacuum sealer according to claim 7, wherein said water tank is detachably connected to said first vacuum chamber.

15. The multifunctional vacuum sealer according to claim 1, wherein a reversing valve is respectively positioned between said vacuum pump assembly and said internal vacuum pumping and sealing mechanism, as well as between said vacuum pump assembly and said cavity vacuum pumping and sealing mechanism; said reversing valve serves to switch said vacuum pump assembly to evacuate said corresponding vacuum cavity.

16. The multifunctional vacuum sealer according to claim 1, wherein said second vacuum chamber is a recessed space in said upper section of said casing.

* * * * *